US005110012A

United States Patent [19]

Scholle et al.

[11] Patent Number: 5,110,012

[45] Date of Patent: May 5, 1992

[54] BEVERAGE CONTAINER WITH REGULATED PRESSURE

[75] Inventors: William R. Scholle, Corona Del Mar; William T. Lloyd-Davies, Irvine; Chester Savage, both of Irvine, all of Calif.

[73] Assignee: Scholle Corporation, Irvine, Calif.

[21] Appl. No.: 640,202

[22] Filed: Jan. 11, 1991

[51] Int. Cl.[5] ..... B65D 83/14

[52] U.S. Cl. ..... 222/83.5; 222/396; 222/399; 222/400.7

[58] Field of Search ..... 222/399, 396, 400.7, 222/397, 481, 481.5, 83.5, 88, 83

[56] References Cited

U.S. PATENT DOCUMENTS

| | | | |
|---|---|---|---|
| 1,015,987 | 1/1912 | Bijur et al. . | |
| 2,238,686 | 4/1941 | Ensminger . | |
| 2,442,648 | 6/1948 | Goldman | 222/5 |
| 2,506,983 | 5/1950 | Williams . | |
| 2,676,475 | 4/1954 | Nissen . | |
| 2,732,873 | 1/1956 | Treiber . | |
| 2,786,333 | 3/1957 | Makara . | |
| 2,812,109 | 11/1957 | Wentz | 222/52 |
| 2,812,783 | 11/1957 | Bufogle . | |
| 2,842,293 | 7/1958 | Knapp et al. | 222/399 |
| 2,921,711 | 1/1960 | Mack | 222/5 |
| 3,195,788 | 7/1965 | Wilson | 222/399 |
| 3,197,144 | 7/1965 | Kochner . | |
| 3,209,949 | 10/1965 | Gurtler | 222/49 |
| 3,211,350 | 10/1965 | Brown | 222/399 |
| 3,227,309 | 1/1966 | Segrest | 222/1 |
| 3,228,559 | 1/1966 | Couffer | 222/52 |
| 3,233,780 | 2/1966 | Cheeley | 222/52 |
| 3,243,085 | 3/1966 | Wilson | 222/396 |
| 3,307,751 | 3/1967 | Kraft | 222/464 |
| 3,420,418 | 1/1969 | Rousset et al. | 222/399 |
| 3,452,902 | 7/1969 | Cornelius | 222/61 |
| 3,459,331 | 8/1969 | Hogg | 222/5 |
| 3,675,722 | 7/1972 | Balmes, Sr. | 169/30 |
| 3,712,319 | 1/1973 | Rhodes et al. | 137/68 |
| 3,780,693 | 12/1973 | Parr | 116/70 |
| 3,789,861 | 2/1974 | Conn et al. | 134/166 |
| 4,011,971 | 3/1977 | Haydon | 222/399 |
| 4,189,068 | 2/1980 | Apellaniz | 222/83.5 |
| 4,735,348 | 4/1988 | Santoiemmo et al. | 222/399 |

FOREIGN PATENT DOCUMENTS 1272060 7/1968 Fed. Rep. of Germany .

*Primary Examiner*—David H. Bollinger

*Attorney, Agent, or Firm*—Richard F. Carr; Richard L. Gausewitz; Allan Rothenberg

[57] ABSTRACT

This invention provides a dispenser for a beverage, such as beer, in which the contents of the container are pressurized by gas from a cartridge in the container. A pressure responsive member in the container is movable in response to differences in pressure between that of the atmosphere and of the inside of the container. A valve member is carried by the pressure responsive member and includes a tapered pin for forming an opening through a diaphragm over the cartridge outlet and metering the discharge of gas from the cartridge in response to movements of the pressure responsive member.

18 Claims, 5 Drawing Sheets

FIG. 1.
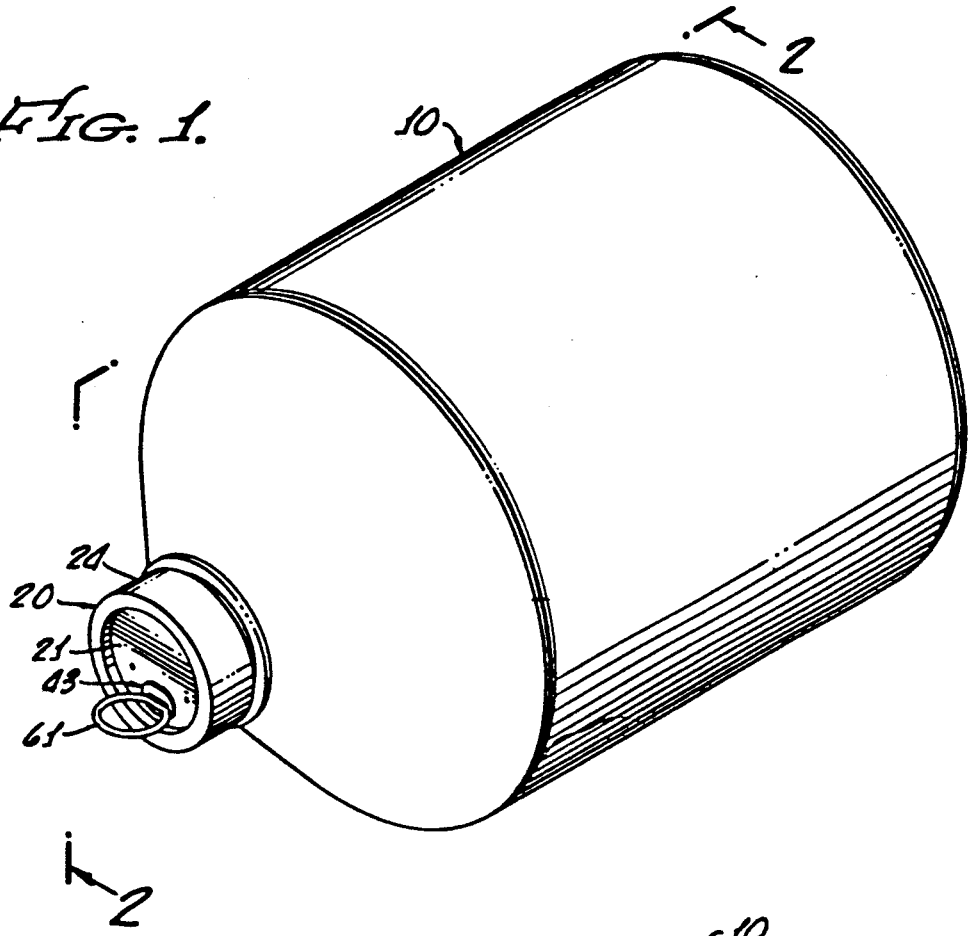
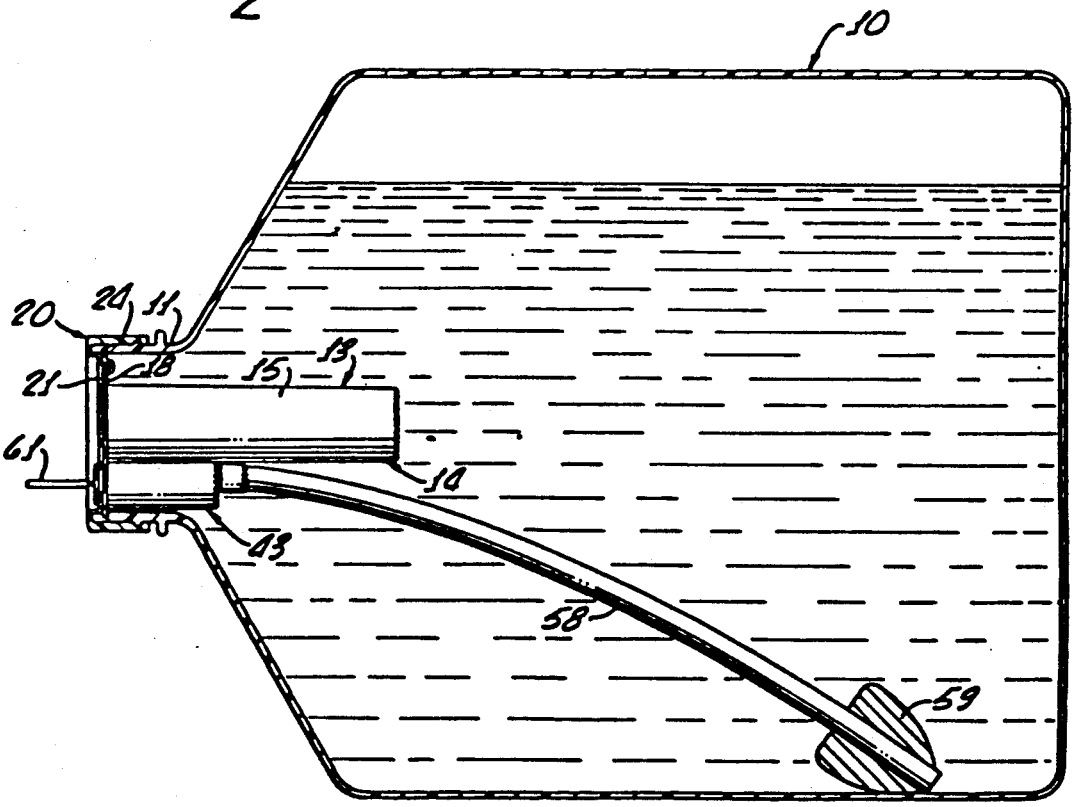
FIG. 2.

FIG. 3.
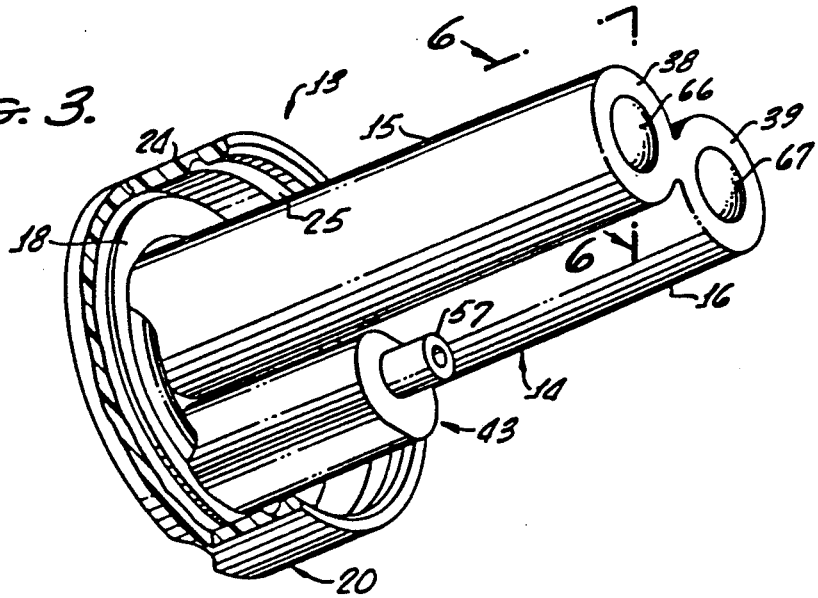
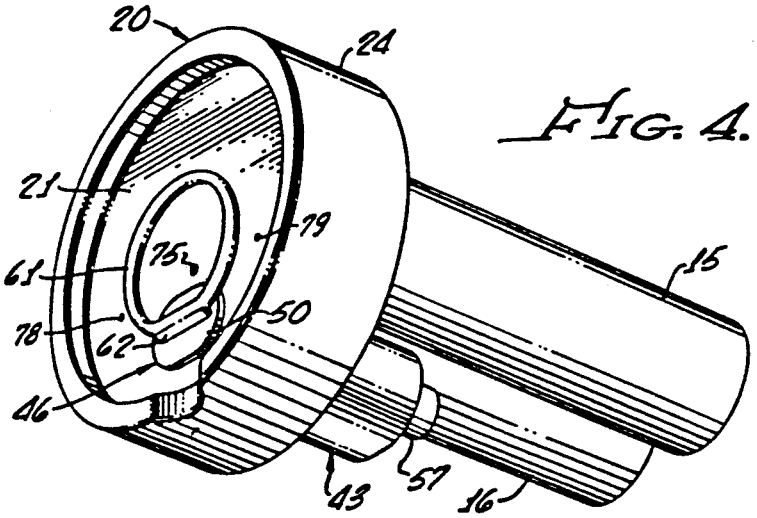
FIG. 4.
FIG. 5.
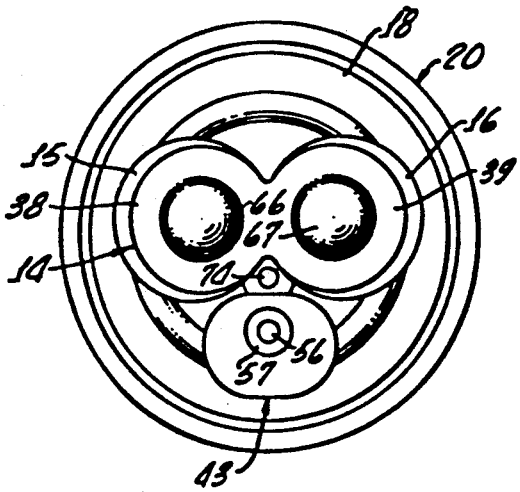
FIG. 6.
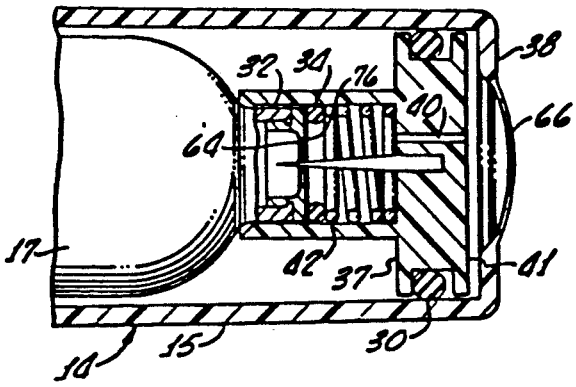

BEVERAGE CONTAINER WITH REGULATED PRESSURE

BACKGROUND OF THE INVENTION

In the past there has been no low cost and effective device, suitable for home use, for retaining a substantial quantity of carbonated beverage, such as beer, while at the same time permitting it to be dispensed over a period of time without losing its carbonation. Many prior devices have been bulky, expensive, heavy, not entirely foolproof in operation, and have been returnable rather than disposable.

SUMMARY OF THE INVENTION

The present invention provides a simplified, reliable, low-cost, disposable home beer dispenser overcoming the objectionable features of prior devices. Most of its components are of plastic so that it is light in weight and nonbreakable.

The device includes a container having a neck within which fits the regulating and dispensing unit. An outlet spigot dispenses the beer which is pressurized within the container. The pressure is maintained by gas from one or more carbon dioxide cartridges. The $CO_2$ gas from the cartridges is regulated automatically so that a predetermined pressure is maintained within the container.

In the regulator, each of the cartridges is received in a cylinder where it is subjected to atmospheric pressure around most of its exterior Within the cylinder is a pressure responsive element, such as a piston or diaphragm, which is subjected to the pressure within the container on one side. A sleeve projects from the central portion of the opposite side of the piston or diaphragm and receives the neck of the cartridge with respect to which it is sealed. Outside of the sleeve, that side of the pressure responsive element experiences atmospheric pressure. A tapered pin projects from the center of the pressure responsive element and, when the regulator is activated, punctures the membrane which forms a closure for the end of the cartridge to form an opening through which the $CO_2$ gas can escape From the cartridge, the gas flows through an opening in the pressure responsive element and in the end of the cylinder into the container for pressurizing the contents of the container.

Regulation is effected by the pressure within the container acting on one side of the pressure responsive element and atmospheric pressure on part of the other side of the pressure responsive element, along with the pressure of the gas from the cartridge within the sleeve portion and a biasing spring. The latter element may be a resilient elastomeric member that also provides a seal. The piston is movable in response to pressure differentiations, shifting the tapered pin relative to the opening in the cartridge to control the effective discharge area of the opening. This automatically controls the pressure within the chamber.

The cylinder may be provided with an end wall having a thin-sectioned portion which will bulge outwardly from the gas discharging from the cartridge after the diaphragm has been ruptured by the tapered pin. This provides a visual indication that the cartridge has been activated and the unit is ready for service. When it is time to assemble the regulator and the container, the thin-section portion of the end wall is punctured and the regulator unit quickly associated with the container so that the $CO_2$ gas can then flow into the container to pressurize the contents.

A pressure relief valve may be included to vent any pressure excesses.

The outlet spigot, unless located at the bottom of the container, receives liquid from a flexible tube having a weight on one end which will sink to the bottom of the container to assure that all of the liquid can be drawn from the container and also that the gas cannot be vented from the container as long as liquid is present. The hose may include a restriction near its inlet to provide a pressure drop and prevent foaming.

BRIEF DESCRIPTION OF THE DRAWINGS

FIG. 1 is a perspective view of a container embodying the invention;

FIG. 2 is a longitudinal sectional view, taken along line 2—2 of FIG. 1;

FIG. 3 is a perspective view, partially broken away, of the regulator and liquid dispensing unit;

FIG. 4 is a perspective view of the regulator and dispensing unit, taken from a different angle from that of FIG. 3;

FIG. 5 is an end view of the regulator and dispensing unit;

FIG. 6 is an enlarged, fragmentary, sectional view, taken along line 6—6 of FIG. 3;

DETAILED DESCRIPTION OF THE INVENTION

Figure 7:
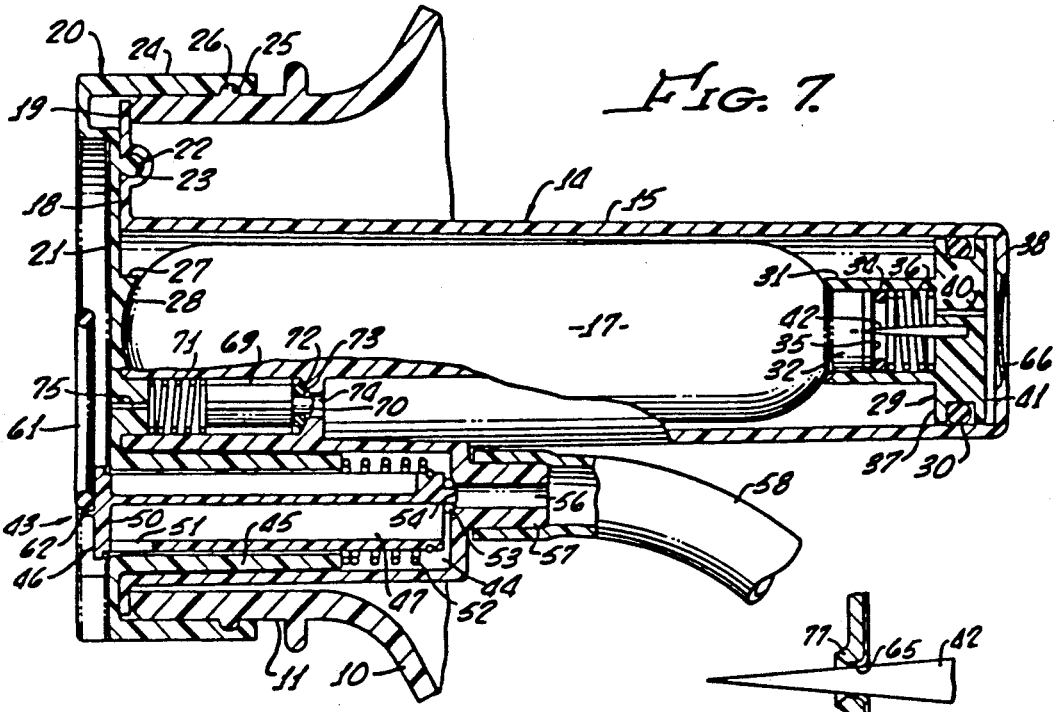
FIG. 7 is an enlarged, sectional view of the regulator unit in the neck of the container in a static condition, with the valve member closing the discharge opening from the cartridge.

Shown in FIGS. 1 and 2 is a cylindrical plastic container 10 with a neck 11 at one end, retaining a quantity of a beverage such as beer 12. A control unit 13 is carried by the neck 11 of the container 10, fitting inside the container to provide regulated pressure on the liquid 12, pressure relief in the event of overpressurization of the container, and a spigot for dispensing the liquid.

The control unit 13 includes a plastic member 14 defining two identical elongated, tubular receptacles 15 and 16, each of which is dimensioned to receive a small standard cartridge 17 containing pressurized carbon dioxide. The cartridges may be of under 25 grams of $CO_2$ capacity, usually within the range of 16 to 22 grams. A cartridge containing around 17.5 grams of $CO_2$ has been found to be satisfactory.

A flange 18, shaped as a circular disc at the base of the plastic member 14, extends outwardly in radial plane so as to bear against the end edge 19 of the neck 11 of the container 10. This flange is held in place by an end cap 20 which has an end wall 21 with an undercut rib 22 that snaps into a complementary recess 23 in the flange to hold these elements together. The end cap 2 also includes a cylindrical part 24 provided with a groove 25 complementarily receiving a rib 26 that circumscribes the neck 11, holding the end cap to the container. The end wall 21 includes a thickened part 27 where it covers each of the receptacles 15 and 16, with a curved recess 28 to receive and position the end portion of the cartridge 17.

Within each of the receptacles 15 and 16 is a piston 29, sealed relative to the cylindrical wall of the receptacle by an O-ring 30. A sleeve 31, smaller in diameter than the piston 29, extends from the central portion of the piston toward the cartridge 17. The sleeve 31 closely receives the neck 32 of the cartridge and terminates in an inwardly tapered end edge 33. Within the sleeve 31 is an O-ring 34, biased against the end 35 of the neck 32 of the cartridge by one end of a compression spring 36. The other end of the spring 36 bears against the radial end wall 37 of the piston 29. The O-ring 34 provides a seal to prevent leakage between the cartridge neck 32 and the sleeve 31. The spring 36 also presses the piston 29 toward the inner end wall 38 of the receptacle 15, illustrated in section in FIGS. 6, 7 and 8, with the corresponding piston in the receptacle 16 being urged toward the end wall 39 of that receptacle. A small opening 40 through the piston 29 provides communication between the space within the tubular element 31 and the portion of the receptacle 15 beyond the piston 29, between the end 41 of the piston and the inner receptacle wall.

A tapered metal pin 42 is carried by the piston 29, projecting from the center of the wall 37 toward the neck 32 of the $CO_2$ cartridge 17. This pin is used in opening the cartridge and regulating the flow of gas from it, as explained below.

Figure 8:
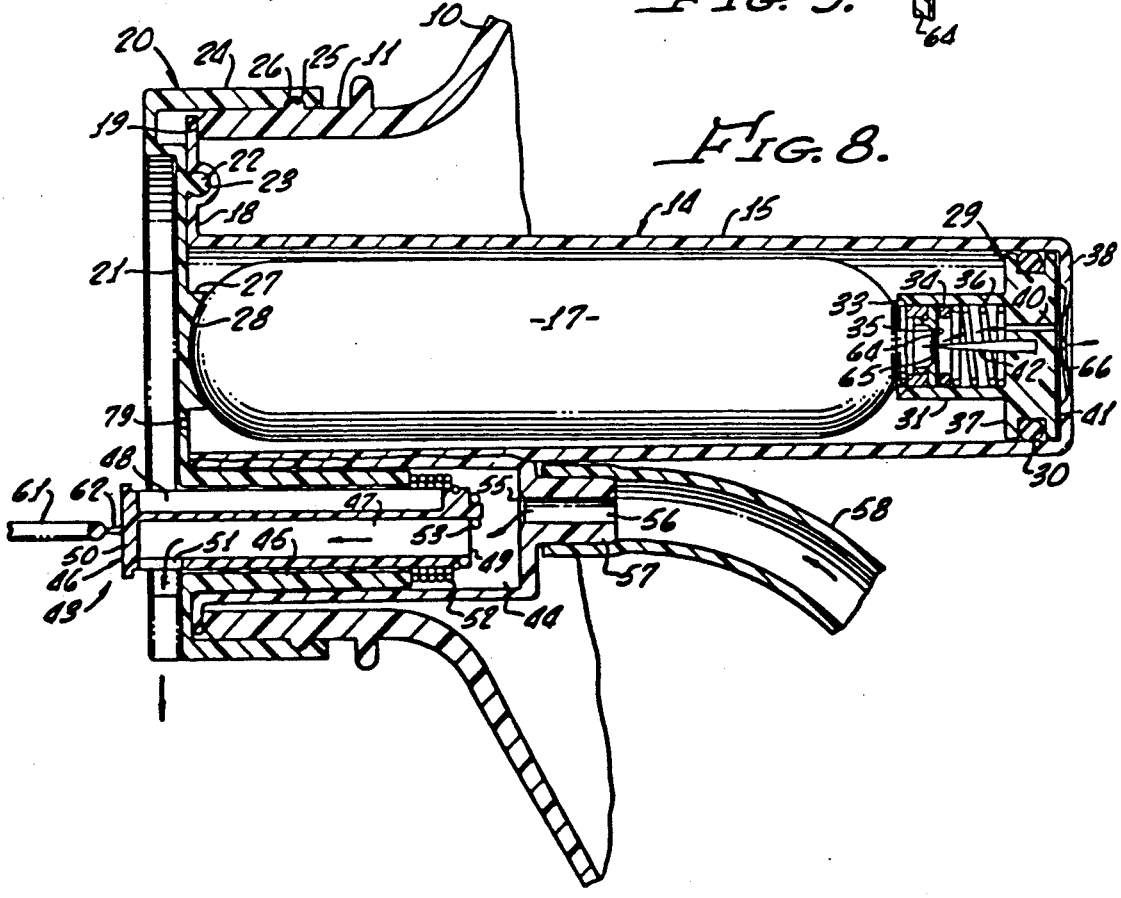
FIG. 8 is a view similar to FIG. 7, but with the valve member opened to permit flow of pressurized gas into the container as liquid is being drawn from the container.
Figure 10:
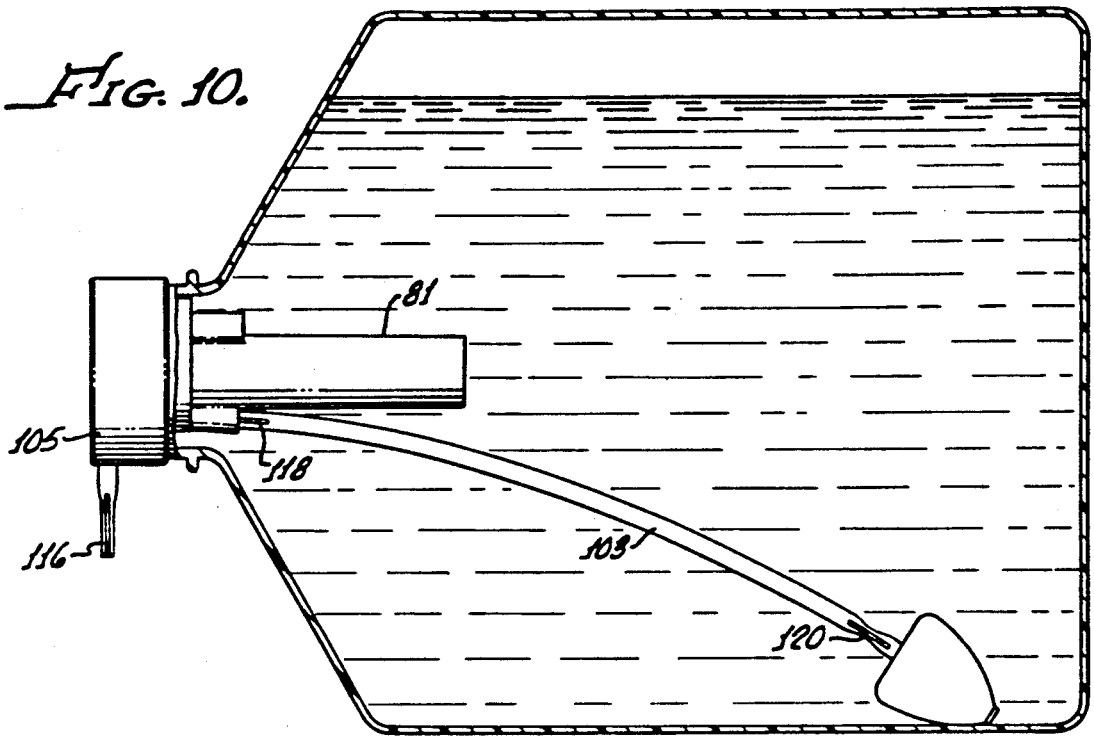
FIG. 10 is a longitudinal sectional view of a container and modified form of the invention.

The unit 13 also includes a spigot assembly 43, best seen in FIGS. 7 and 8, used in dispensing the liquid 12 from the container 10. An elongated chamber 44 is included in the assembly 43, receiving a tubular extension 45 of the cap 20 at its outer end. A plunger 46, slidable within the tubular extension 45, includes a tubular part 47 and a longitudinal rib 48 which assists in guiding it longitudinally. The inner end 49 of the tubular part 47 is open and the outer end 50 is closed, but an additional opening 51 is provided in the lower wall of the tubular part 47 adjacent the outer end. One end of a compression spring 52 bears against the end of the tubular extension 45 of the cap 20, and the opposite end of this compression spring is received in a groove in the periphery of the inner end of the plunger 46. This biases the plunger inwardly toward the position shown in FIG. 7. When in this position, an O-ring 53, circumscribing a short longitudinal protuberance 54 at the inner end of the plunger, bears against a seat 55 at the entrance to an opening 56 in the inner end of the chamber 44. The opening 56 forms the bore of a short tubular section 57 of reduced diameter projecting from the receptacle 44. One end of a flexible plastic hose 58 receives the tubular section 57. At the opposite end of the hose 58 is a weight 59, causing that end of the hose 58 to lie adjacent the bottom of the container 10 so as to assure that it will receive liquid, irrespective of the attitude of the container.

Liquid is dispensed by pulling the plunger 46 outwardly to the position of FIG. 8. This is accomplished by means of a ring 61, connected by a plastic hinge 62 to the outer end of the plunger. The free position of the hinge 62, and hence the ring 61, is that of FIG. 8, in which the ring projects directly outward from the plunger. For shipment, however, the ring is pivoted upwardly about the hinge 62 to the position shown in FIG. 7 where it is held in position by a means, not shown, so that the unit is compact and the ring 61 will not become damaged.

When the plunger 46 is pulled outwardly, the opening 50 then is beyond the end wall 21 of the closure member 20 so that liquid can flow downwardly through the opening 51 into a tumbler or other receptacle. This liquid comes from the hose 58, through the bore 56, into the receptacle 44, and through the tubular part 47 of the plunger. Release of the ring 61 causes the plunger to move to the right, as the device is illustrated, under the bias of the compression spring 52 so that the O-ring 53 engages the seat 55 to seal off the bore 56 and hence, to prevent liquid from flowing outwardly from the interior of the container 10.

When the unit 13 is assembled and prior to its association with the container 10, the metering pins 42 are caused to puncture the membranes 64 at the necks of the two $CO_2$ cartridges 17. This occurs as the cap 20 is pressed into place to connect to the member 14 as the thickened parts 23 of the end wall 22 drive the cartridges 17 toward the inner ends of the receptacles 15 and 16. With the pistons 29 bottomed against the en walls 38 and 39 of the receptacles 15 and 16, the cartridges 17 move axially relative to the pistons which causes the pins 42 to pierce the membranes 64, which normally seal the cartridge ends, forming openings 65 and allowing $CO_2$ gas to escape. The extent of the relative movement of the cartridges 17 and pistons 29, and hence the degree of penetration of the metering pins 42, is governed by the sleeves 31 projecting from the pistons which engage the cartridges 17 adjacent the necks 32 at their beveled ends 33. This limits the travel of the pistons toward the cartridges 17 and, hence, controls the maximum size of the openings formed through the membrane 64.

When the membranes 64 are pierced, the escaping $CO_2$ gas flows through the sleeves 31 and the openings 40 to the space adjacent the outer ends 41 of the pistons and the end walls 38 and 39 of the receptacles 15 and 16. This subjects the outer ends 41 of the pistons 29 to pressure which urges them toward the cartridges 17, to the left, as illustrated, closing off the openings 65 formed in the membranes 64. At the same time, the thin central sections 66 and 67 of the inner end walls 38 and 39 of the receptacles 15 and 16 are bulged outwardly, as may be seen in FIG. 6. The thin end wall sections 66 and 67 normally are concave when viewed from the exterior, so that, when bulged outwardly by the pressure of the gas, they give a visual indication that the cartridges have been pierced and the unit is activated. This means that it is ready for assembly with the container 10. Also, the pressure within the receptacles 15 and 16 will drive the cartridges outwardly to deflect the end wall 21 to some extent, increasing the effective lengths of the receptacles and the degree of movement permitted the pistons 29. In all positions of the pistons 29, the pins remain within the openings 65 in the membranes 64.

In the assembly process, the thin parts 66 and 67 of the end walls are punctured by any suitable pointed instrument, allowing the $CO_2$ gas to begin to flow out of the containers 15 and 16. Quickly, the unit 13 is associated with a full container, positioned vertically, and the cap 20 is snapped into place so as to seal the inside of the container from the atmosphere. This means that the gas escaping from the cartridges 17 can only enter the container 10 where it serves to pressurize the liquid 12.

The pressure within the container 10, generated by the gas from the cartridges 17, reacts against the ends 41 of the pistons 29, producing a force biasing these pistons toward the cartridges 17. The ambient pressure externally of the container 10 also exists in the receptacles 15 and 16, reacting against the portions of the outer piston ends 37 outside of the sleeves 31. Within the latter elements, the pressurized $CO_2$ gas reacts on a smaller area of the pistons 29, producing a smaller force biasing the pistons 29 away from the cartridges 17 than produced by the gas on the opposite ends of the pistons. This is augmented by the springs 36.

The pressurized gas within the container 10 provides a means for forcing the liquid 12 from the container 10, maintains the carbonation of the liquid, and protects it from the atmosphere.

In dispensing the liquid 12, the plunger 46 is pulled outwardly, as noted above, opening the passageway through the tube 58, bore 56 and receptacle 44 to the outlet opening 51. As the gas within the container 10 forces the liquid 12 outwardly through the spigot, the pressure within the container 10 is reduced. This lowers the net force on the ends 41 of the pistons 29, resulting in an unbalanced force urging the pistons outwardly away from the cartridges 17. Therefore, the pistons 29 move outwardly toward the ends 38 and 39 of the receptacles 15 and 16, withdrawing the tapered metering pins 41 partially from the openings 65 formed in the cartridge membranes 64. This allows an increased quantity of gas to flow into the container 10. As the spigot is closed after drawing the liquid, the container 10 is sealed and pressure builds up in the container to again provide the desired amount of pressurization of the liquid. The piston areas and springs 52 are coordinated such that the pistons are moved toward the cartridges 17 to cause the metering pins 42 to shut off the openings 65 through the cartridge necks when the pressure within the container is at the desired value. Consequently, the liquid 12 always is maintained properly pressurized.

As a safety precaution, a pressure relief valve may be included to guard against the unlikely occurrence of overpressurization of the container 10. This valve is incorporated in the unit 13, and includes a plunger 69 with a cylindrical short pin 70 at its inner end, biased inwardly by a compression spring 71. A seal 72 circumscribes the pin 70 and normally engages the tapered seat 73 that leads to an opening 74, communicating with the interior of the container 10. Excessive pressure in the chamber 10 will react against the end of the pin 70 and the seal 72 to move the plunger 69 outwardly, uncovering the opening 74 and providing a vent through passageway 75 in the wall 21 to the exterior of the container to relieve the pressure.

Figure 9:
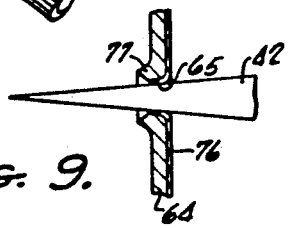
FIG. 9 is an enlarged fragmentary sectional view illustrating the sealing arrangement for the pin at the cartridge.

For most effective operation of the unit, and to maximize its service life after being activated, it is important that the pin 42 forms an effective seal at the membrane 64 when in the closed position Otherwise, gas will continue to flow through the opening 65 around the pin 42, even if at a slow rate, ultimately becoming dissipated so that the ability to pressurize the contents of the container is lost. The sealing effect may be enhanced by providing on the outer surface of the membranes 64 a coating 76 of relatively soft material, as seen in FIG. 9. The coating 76 may be a relatively soft plastic. A relatively soft metal, such as copper, also may be used.

The membrane 64, being of metal, will be deflected inwardly by the tapered pin 42 as the latter member punctures the membrane. This produces a somewhat conical indentation 77 at the opening 65, with the coating 76 being on the inside. As a result, the coating 76 is presented to the pin as the pin enters the opening. The pin bears against the coating 76 when the unit is in the closed position, effectively sealing around the pin so that the loss of $CO_2$ gas is either zero or a minimal amount.

In order to assure that the insides of the receptacles 15 and 16 are at ambient atmospheric pressure, vent openings 78 and 79 may be provided through the end wall 21. This provides communication from the exterior of the unit through the end wall 21 into the chambers 15 and 16 for reacting against the piston ends 37.

The embodiment of FIGS. 10–16 is of simplified construction, minimizing the number of parts and reducing the cost of production. A receptacle 81 receives a single $CO_2$ cartridge 82, with a bleed opening 83 in the outer end wall 84 to permit ambient air pressure to exist around the exterior of the cartridge. The end of the cartridge 81 seats in the opening 83, and the opening may be provided with a notch to assure communication from the exterior to the interior of the receptacle 81. At the inner end of the receptacle 81 is a diaphragm 85 that has a relatively thin wall and is annular in configuration, its outer periphery being integral with the end of the cylindrical wall of the receptacle 81. At the center of the flexible diaphragm 85 is a thicker and more rigid wall 86 that is integral with the diaphragm at its inner edge. A sleeve 87 projects from the outer edge of the wall 86, extending around the neck 88 of the cartridge 82, being in this respect similar to the sleeve 31.

Received within the sleeve 87, between the wall 86 and the end of the neck 88 of the cartridge 82, is a member 89 of resilient elastomeric material. The member 89 has a cylindrical side wall 90 and radial end walls 91 and 92, which engage the cartridge end 88 and the wall 86, respectively. The cylindrical side wall 90 is spaced from the inner surface of the sleeve 87. However, at one end of the member 89, adjacent the end of the cartridge 82, is a radially projecting flange 93. The latter element fits closely within the sleeve 87, forming a fluid-tight seal. The flange 93, therefore, takes the place of the separate O-ring seal 34 of the previously-described embodiment. Moreover, the member 89, being of resilient elastomeric material, acts as a spring pressing outwardly on the wall 86. This force is opposed by the force exerted by the pressurized gas within the container reacting against the wall 86 and the diaphragm 85. The member 89, therefore, replaces both the O-ring seal 34 and the compression spring 36 of the previously-described embodiment.

At the axis of the resilient member 89 is a cylindrical opening 94 within which is a pin 95 that is used in piercing the membrane 96 at the neck 88 of the cartridge 82 and regulating the flow of gas into the container. One end of the pin 95 is carried by the wall 86. Three small holes 97 are provided around the pin 95 at the wall 86, providing a path for the gas that flows outwardly through the opening 94 into the container. The operation of the embodiment of FIGS. 10-13 corresponds to that of the previously-described embodiment. The diaphragm 85 and wall 86 provide a pressure responsive element that moves the pin 95 toward and away from the cartridge membrane 96 to control the flow of gas through the opening formed in the membrane by the pin.

Figure 14:
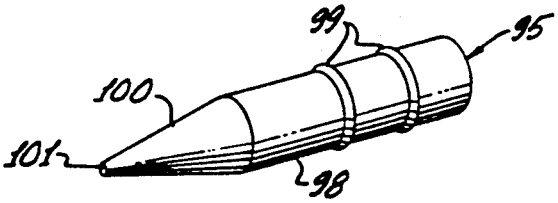
FIG. 14 is a perspective view of the tapered pin for controlling the flow of gas from the cartridge.

One embodiment of the pin 95, shown in enlarged detail in FIG. 14, includes a cylindrical end portion 98 having two narrow flanges 99, inclined on one end, which help hold the pin in the opening provided for it in the wall 86. A frustoconical part 100 extends from the cylindrical portion 98, tapering at around a 25 degree included angle. The frustoconical part 100 terminates in a narrow radial flat end surface 101. In one example, where the cylindrical portion 98 of the pin 95 has a diameter of 0.095 inch, the outer end surface 101 has a diameter of 0.015 inch. The slightly blunted end 101 of the pin 95 allows the cartridge membrane to be penetrated without being torn or distorted so that the pin cannot seat properly. Also, the angle of the taper of the frustoconical surface 100 helps assure uniform separation and deflection of the cartridge membrane at the opening that is formed.

A pressure relief valve 102 may be included adjacent the receptacle 81, its housing being a portion of the same molded part as that of the receptacle.

The hose 103 for dispensing the liquid from the container extends through a guide channel 104 formed integral with the receptacle 81 and into an end cap 105 which incorporates the valve for regulating the flow through the hose. The end cap 105 includes a tubular undercut inner end flange 106 that snaps over a shoulder 107 on the end of the neck of the container, which holds not only the end cap but also the receptacle 81 within the container. This is because an extension of the receptacle 81 includes a radial flange 108 at its outer end which is positioned between the outer end edge 109 of the neck of the container and an inwardly facing radial shoulder 110 on the end cap 105. A curved opening 111 in the end cap 105 forms a continuation of the guide channel 104 and allows the hose 103 to extend to the exterior of the container.

Figure 11:
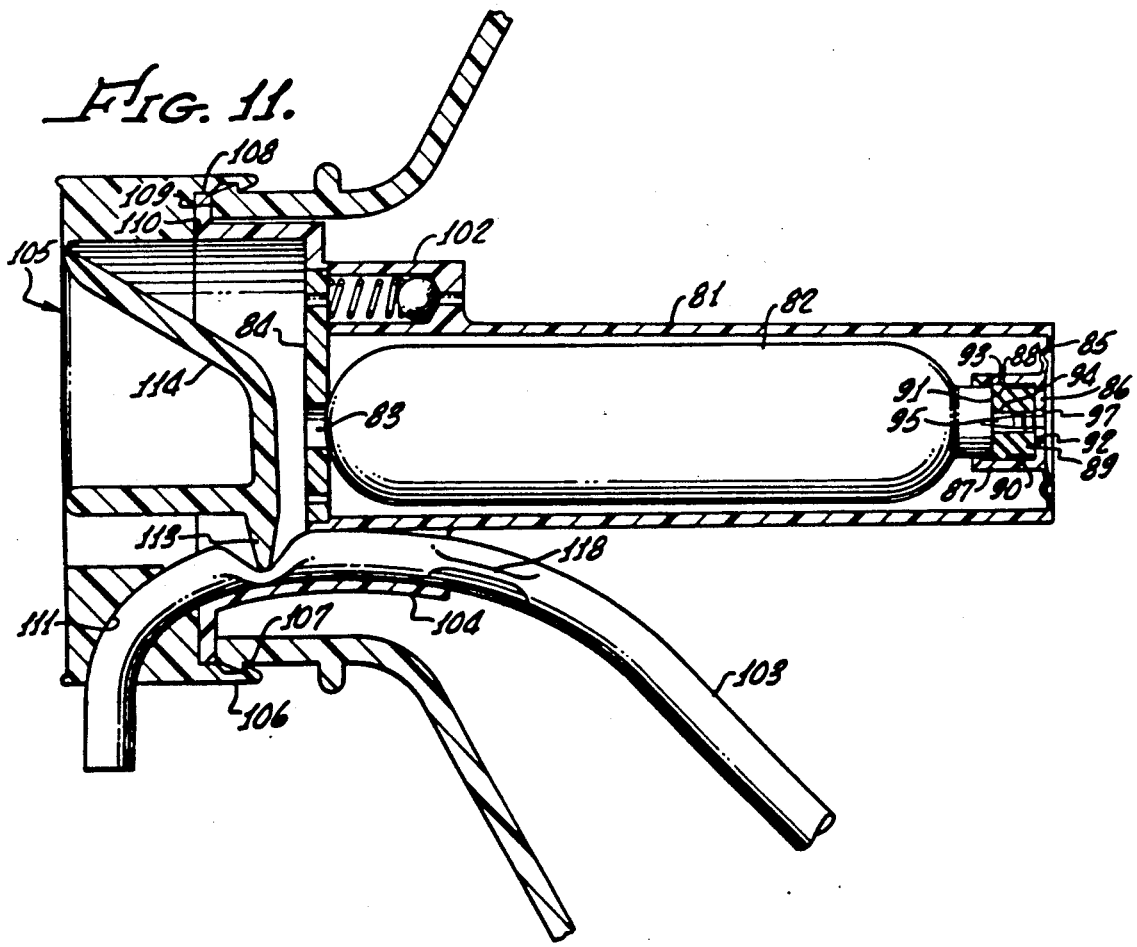
FIG. 11 is an enlarged longitudinal sectional view of the regulator unit of the embodiment of FIG. 10.
Figure 12:
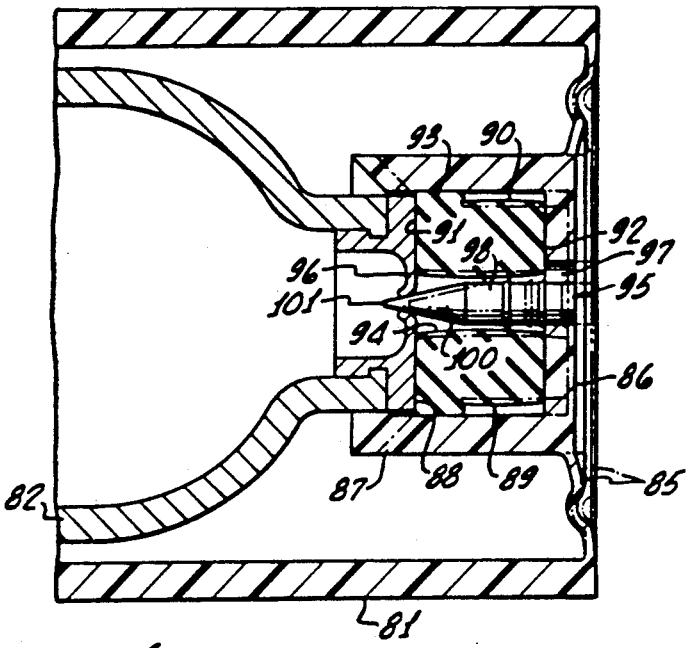
FIG. 12 is an enlarged fragmentary sectional view of one end portion of the regulator unit.
Figure 13:
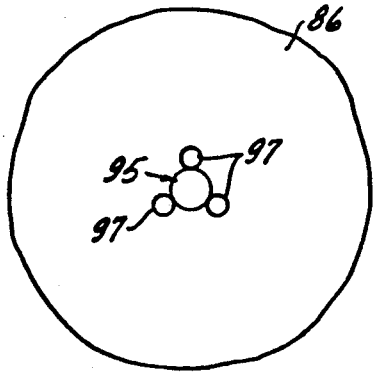
FIG. 13 is a fragmentary end elevational view of the regulator unit.

The valve element includes a ridge 113 connected to plastic spring element 114 that is part of the end cap 105, and causes the ridge normally to assume the position shown in FIG. 11. There the ridge 113 bears against the hose 103, collapsing it against the wall of the guide channel 104. This closes off the hose, preventing flow through it. The hose 103 is opened by pressing on the spring element 114, causing the ridge 113 to pivot away from the hose and allow the hose to assume its full dimension.

Figure 15:
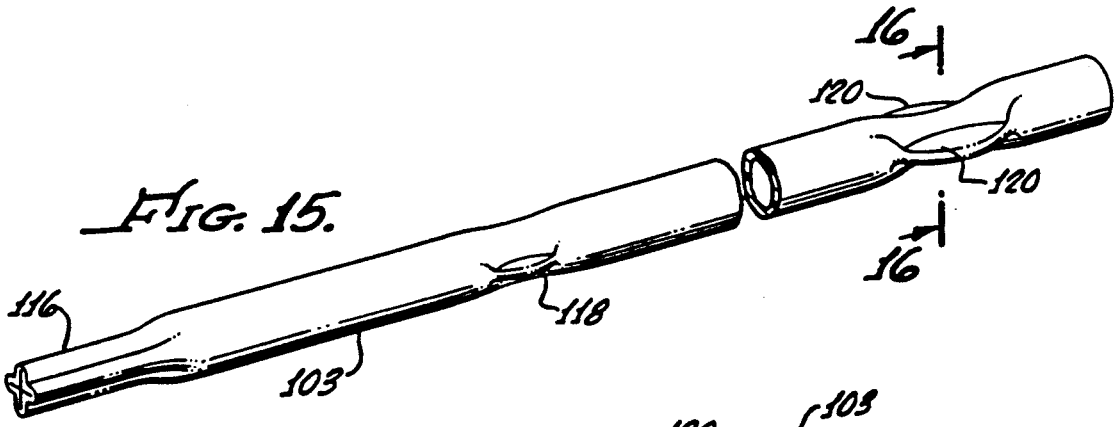
FIG. 15 is a perspective view of the hose for dispensing the liquid.

As the hose 103 is molded, it is pinched together in a cruciform shape at one end 116, as shown in FIG. 15. This closes off that end of the hose, which is the end positioned outside of the container. This seals the dispensing end until time of use, when this part of the hose simply is cut off. The closed pinched end provides for easy assembly.

Inwardly of the end 116 are formed two outwardly extending flanges 118 which are diametrically opposed. These are located at the inner end of the guide channel 104. Their outer edges are spaced too far apart to permit entry of the flanges 118 into the guide channel 104. Hence, these flanges hold the hose 103 within the container and assure that it cannot be pulled out of the container.

Figure 16:
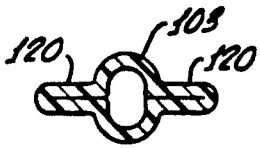
FIG. 16 is a sectional view taken along line 16—16 of FIG. 15.

In addition, wider pinched portions 120 at the inner end of the hose 103 result in a reduced cross section of open area within the hose, as seen in FIG. 16. This provides a restriction that creates a pressure drop for the liquid being dispensed. This is important in preventing a pressurized liquid, such as beer, from foaming as it is allowed to flow from the container. Alternatively, a pressure reducing system may be provided in the end cap 105 to eliminate foaming.

The foregoing detailed description is to be clearly understood as given by way of illustration and example only, the spirit and scope of this invention being limited solely by the appended claims.

What is claimed is:

1. A liquid dispensing device comprising a container having an outlet, means for controlling the flow of liquid from said outlet, at least one cartridge of pressurized gas, said cartridge having a neck at one end thereof, an outlet through said neck, and a membrane over said outlet acting as a closure therefor, means for supporting said cartridge in said container, a pressure responsive member in said container, means for providing communication between a portion of said pressure responsive member and the exterior of said container so that said portion is subjected to the ambient pressure around the exterior of said container, and for providing communication between another portion of said pressure responsive member and the interior of said container so that said other portion is subject to the pressure within said container, said pressure responsive member being movable in response to differences between said ambient pressure and the pressure within said container, a valve member, means for arranging said valve member relative to said pressure responsive member so that said valve member is movable by said pressure responsive member, said valve member including means for forming an aperture in said membrane for discharging gas from said cartridge through said aperture into said container, and for controlling the discharge of gas through said aperture in response to movement thereof by said pressure responsive member, a resilient means engaging said cartridge and said pressure responsive member for providing a seal between said pressure responsive member and said neck and for biasing said pressure responsive member away from said neck, said resilient means having an opening therethrough for receiving and transmitting gas so discharged from said cartridge, said pressure responsive member having an opening therethrough for permitting discharge of said gas from said resilient member into said container.

2. A liquid dispensing device comprising a container having an outlet, means for controlling the flow of liquid from said outlet, at least one cartridge of pressurized gas, said cartridge having a neck at one end thereof, an outlet through said neck, and a membrane over said outlet acting as a closure therefor, means for supporting said cartridge in said container, a pressure responsive member in said container, said pressure responsive member including a diaphragm, means for providing communication between one side of said diaphragm and the exterior of said container so that said one side is subject to the ambient pressure around the exterior of said container, and for providing communication between the other side of said diaphragm and the interior of said container so that the other side of said diaphragm is subject to the pressure within said container, said diaphragm of said pressure responsive member being movable in responsive to differences between said ambient pressure and the pressure within said container, a valve member, means for arranging said valve member so that it is movable by said diaphragm of said pressure responsive member, said valve member including means for forming an aperture in said membrane for discharging gas from said cartridge through said aperture into said container, and for controlling the discharge of gas through said aperture in response to movement thereof by said pressure responsive member, seal means for providing a seal between said pressure responsive member and said neck, said seal means having an opening therethrough for receiving and transmitting gas so discharged from said cartridge, said pressure responsive member having an opening therethrough for permitting discharge of said gas from said seal means into said container, and spring means biasing said pressure responsive member away from said neck.

3. A device as recited in claim 2 in which said valve member includes a tapered pin positioned within said aperture and movable axially toward and away from said cartridge by said pressure responsive member for controlling the effective discharge area of said aperture.

4. A liquid dispensing device comprising a container having an outlet, means for controlling the flow of liquid from said outlet, at least one cartridge of pressurized gas, said cartridge having a neck, an outlet through said neck, and a membrane over said outlet acting as a closure therefor, means for supporting said cartridge in said container, a pressure responsive member in said container, means for providing communication between a portion of said pressure responsive member and the exterior of said container so that said portion is subjected to the ambient pressure around the exterior of said container, and for providing communication between another portion of said pressure responsive member and the interior of said container so that said other portion is subject to the pressure within said container, a pin tapered toward an outer end thereof and positioned adjacent said membrane so that said tapered pin is movable by said pressure responsive member for pressing inwardly against said membrane to locally deflect said membrane inwardly by said outer end of said tapered pin and form an aperture in said membrane for discharging gas from said cartridge through said aperture into said container, said tapered pin being movable longitudinally by said pressure responsive member between a first position adjacent said membrane at said aperture in which position a portion of said pin of relatively large diameter is adjacent said aperture and a second position remote therefrom in which position a portion of said pin of relatively small diameter is adjacent said aperture for controlling the discharge of gas through said aperture, a sleeve projecting from said pressure responsive member and receiving said neck, seal means sealing said sleeve with respect to said neck, and spring means biasing said pressure responsive member away from said neck, said pressure responsive member having an opening therethrough for permitting discharge of gas from said cartridge into said container, said pressure responsive member being biased in one direction by atmospheric pressure and said spring means, and biased in the opposite direction by the pressure within said container, for thereby so moving said tapered pin between said first and second positions thereof.

5. A device as recited in claim 4 in which said pressure responsive member includes a flexible diaphragm.

6. A device as recited in claim 4 in which said means for supporting said cartridge in said container includes a wall, and said pressure responsive member is a diaphragm having a flexible outer portion integral with said wall.

7. A device as recited in claim 4 in which said means for supporting said cartridge in said container includes a wall, and said pressure responsive member is a diaphragm having a flexible outer portion integral with said wall of said means for supporting said cartridge, and a thicker less flexible central portion, said sleeve projecting from said central portion.

8. A device as recited in claim 7 in which said tapered pin is carried by said central portion of said diaphragm.

9. A device as recited in claim 4 in which said seal means and said spring means comprise a resilient member received in said sleeve and engaging said cartridge, said sleeve, and said pressure responsive member.

10. A device as recited in claim 4 in which said seal means and said spring means comprise a member of resilient material received in said sleeve and having a first end engaging said cartridge, a second end engaging said pressure responsive member, a wall between said first and second ends spaced from said sleeve, an annular portion projecting from said wall and engaging said sleeve and forming a seal therewith, and an opening therethrough extending between said first and second ends, said pin being received in said opening in said member of resilient material.

11. A device as recited in claim 4 in which said sleeve has an end adapted to engage said cartridge adjacent said neck for limiting the movement of said pressure responsive member and hence said tapered pin toward said cartridge.

12. A device for applying a regulated pressure within a container for a liquid to be dispensed comprising a unit positionable in a container outlet, said unit including a receptacle, a cartridge of pressurized gas in said receptacle,
said cartridge having a neck, an outlet through said neck, and a membrane over said outlet acting as a closure therefor,
a pressure responsive member having a first side in communication with the interior of said receptacle and a second side in communication with the exterior of said receptacle,
means sealing the periphery of said pressure responsive member with respect to said receptacle,
a sleeve extending from said pressure responsive member and receiving said neck of said cartridge,
said receptacle on said first side of said pressure responsive member being subjected to ambient pressure,
resilient means between said neck and said pressure responsive member for biasing said pressure responsive member away from said neck,
a tapered pin carried by said pressure responsive member within said sleeve,
said tapered pin forming an opening through said membrane and being movable axially relative thereto by said pressure responsive member for varying the effective area of said opening,
said pressure responsive member having an opening therethrough for permitting the discharge of gas from said cartridge to the exterior of said receptacle and into said container,
whereby said second side of said pressure responsive member is subjected to the pressure within said container and said pressure responsive member is movable relative to said receptacle in response to pressure differentials on said sides of said pressure responsive member.

13. A device as recited in claim 12 in which said unit includes spigot means for dispensing liquid from said container.

14. A device as recited in claim 12 in which said unit includes spigot means for discharging liquid from said container, and a pressure relief valve for venting excess pressure from said container.

15. A beverage dispensing device comprising
a container having an outlet,
means for controlling the flow of liquid from said outlet,
at least one cartridge of pressurized gas,
said cartridge having a neck at one end thereof, an outlet through said neck, and a membrane over said outlet acting as a closure therefor,
means for supporting said cartridge in said container,
a pressure responsive piston in said container,
a chamber receiving said piston,
said piston being movable axially relative to said chamber,
means for subjecting a portion of said piston to the ambient pressure around the exterior of said container, and subjecting another portion of said piston to the pressure within said container,
said piston being movable in response to differences between said ambient pressure and the pressure within said container,
a valve member movable by said piston,
said valve member including means for forming an aperture in said membrane for discharging gas from said cartridge through said aperture into said container, and for controlling the discharge of gas through said aperture in response to movement thereof by said piston,
a sleeve of smaller diameter than said piston projecting from said piston and receiving said neck, seal means sealing said sleeve with respect to said neck,
and spring means biasing said piston away from said neck,
said piston having an opening therethrough for permitting discharge of gas from said cartridge into said container.

16. A device as recited in claim 15 in which said sleeve has an end adapted to engage said cartridge adjacent said neck for limiting the movement of said piston and hence said tapered pin toward said cartridge.

17. A device as recited in claim 15 in which said container has a wall means adjacent said piston for containing gas discharged through said opening in said piston, said wall means being adapted to have an opening formed therethrough for discharging said gas so contained.

18. A device as recited in claim 15 in which said wall means has a relatively thin portion adapted to be punctured to form said opening through said wall means, said relatively thin portion being deflectable by said gas from said cartridge for providing a visual indication that said tapered pin has punctured said membrane for permitting said gas to discharge from said cartridge.

* * * * *